US009732962B2

(12) United States Patent
Jedrzejewski

(10) Patent No.: US 9,732,962 B2
(45) Date of Patent: Aug. 15, 2017

(54) SYSTEM AND CHARGING METHOD FOR DUST-FREE FUEL DOSAGE IN SOLID-FUEL STOVES FOR HEATING OF CUBATURE FACILITES

(71) Applicant: Tisoft Wojciech Jedrzejewski, Inowroclaw (PL)

(72) Inventor: Wojciech Jedrzejewski, Inowroclaw (PL)

(73) Assignee: TISOFT WOJCIECH JEDRZEJEWSKI, Inowroclaw (PL)

( * ) Notice: Subject to any disclaimer, the term of this patent is extended or adjusted under 35 U.S.C. 154(b) by 414 days.

(21) Appl. No.: 14/607,740

(22) Filed: Jan. 28, 2015

(65) Prior Publication Data

US 2016/0178208 A1 Jun. 23, 2016

(30) Foreign Application Priority Data

Dec. 17, 2014 (EP) ..... 14460109

(51) Int. Cl.
*F24B 13/04* (2006.01)
*F23K 3/00* (2006.01)

(52) U.S. Cl.
CPC ..... *F24B 13/04* (2013.01); *F23K 3/00* (2013.01)

(58) Field of Classification Search
CPC ..... B65G 53/40; B65G 65/34; B65G 65/40; B65G 65/4881; F23K 3/00; F24B 13/04
See application file for complete search history.

(56) References Cited

FOREIGN PATENT DOCUMENTS

| | | |
|---|---|---|
| PL | 93005 | 4/1992 |
| PL | 310873 | 4/1997 |
| PL | 181610 | 6/1997 |
| PL | 66124 | 6/2011 |

*Primary Examiner* — Jason Lau
(74) *Attorney, Agent, or Firm* — Katten Muchin Rosenman LLP

(57) ABSTRACT

Described herein is a charging system for dust-free fuel feeding, comprising a loading chamber, container, and belt conveyor located in the chamber, wherein the loading chamber is bipartite and its lower part, charging is a rectangular body, closed in the lower part by the arched profiled surface of the bottom, located at an angle in respect to the walls of chamber, connected in the lower part with the chamber of the belt conveyor, wherein the brackets are placed in the upper part of the chamber, fastened horizontally to the wall of the charging chamber, in the lower part of the chamber there is an inlet of suction port of turbine, and the loading chamber has cylindrical shape, which the top edge has arched outline, forming funnel profile, closed at the inlet by a flexible membrane and the ratchet mechanism is placed on the external surface of the chamber.

4 Claims, 4 Drawing Sheets

SYSTEM AND CHARGING METHOD FOR DUST-FREE FUEL DOSAGE IN SOLID-FUEL STOVES FOR HEATING OF CUBATURE FACILITES

FIELD OF THE INVENTION

The subject matter of the invention is a system and charging method for dust-free fuel delivering and dosage to solid-fuel stoves, especially eco-peas, fine coal, sawdust, pellets. According to current data coal is the cheapest fuel, about 40% cheaper than natural gas, which is used for heating residential and office buildings. Current ecological retort furnaces reach the high efficiency of about 90%.

BACKGROUND OF THE INVENTION

The number of solutions of solid-fuel stoves and methods of fuel storage as well as fuel loading to dosing chamber and combustion chamber are known. Most of the known solutions are realized by charging of the container and then gravitational settling of the fuel in the fuel dosing feeder to combustion chamber.

The solid-fuel stove for central heating is known from the patent description PL66124 in which pellet is supplied to the furnace through the worm feeder for powder materials without a core, which is connected to the gear-motor by an output shaft, axially fixed in two bearings.

The stove has the furnace with open combustion chamber, wherein combustion takes place on specially casted iron grates, in which aeration slots or aeration holes are arranged at an angle. The primary air is supplied from the bottom of the cast-iron grates. The secondary air is supplied through aeration holes located over the cast-iron grates in slanted side walls of the furnace. The furnace is cooled by air passing first behind automatic poker and then along the feeding tube of the pellet and finally to the aeration holes. The vertical water jacket is place on both sides of the furnace and is connected to the tubular heat exchanger which is arranged in series in relation to the furnace in the heat exchanger chamber which is placed next to the combustion chamber. Water is being pre-heated and at the same only the initial pre-cooling of exhaust gas takes place. This allows exhaust gas, which floats up above the furnace and then moves down through the passage to the bottom part of the heat exchanger chamber, to maintain very high temperature and effectively heat even the lowest parts of the tubular heat exchanger as well as the plane exchanger, arranged alongside.

Patent description PL181610 discloses a central heating solid-fuel stove. The central heating stove has the first stage combustion chamber and the second stage combustion chamber which is placed just behind the first stage combustion chamber and arranged in the form of vertical channels connected in series. The walls of vertical channels are water-cooled and are the heat exchanger. The vertical wall of the first stage combustion chamber which separates it from the second stage combustion chamber has at least one vertical slot placed just above the water-cooled grate, made of triangular profiles. Furthermore in the front wall of the first grade combustion chamber there is the fuel chute closed by a flap which has the upper air inlet. Under the water-cooled grate, which is the bottom of the first grade combustion chamber, there is the adjustable bottom air inlet. Furthermore, in the upper part of the first grade combustion chamber there are water-cooled fire tubes, arranged parallel to each other, which are the main heat exchanger.

Invention description PL310873 discloses the central heating fine coal stove, designed for use in small objects. The stove is characterized by the coal bunker which is closed at the bottom, above the upper part of the grate, by feeder drum fixed rotationally in the frame. Before the upper part of the grate the frame is equipped with the guide of the push rod hinged with connecting-rod of feeder drum propeller shaft. On the other hand, in the coal bunker there is the decompaction device, rotationally fixed in the frame, which driving lever is hinged by its connecting rod with propeller shaft of feeder drum.

The model description PL 93005 discloses the stove with rotational sawdust firmer located above the feeding channel with air flow holes and the bottom part of the feeding channel is connected with one side of the grate and the other side of the grate is connected with the wall having holes. The stove body is connected with the blower having the strangler. The air flow channel with strangler is placed under the grate.

The main disadvantage of the known solutions of fuel supplying is the small capacity of feeding containers in the stoves with warm feeders, resulting in the need of frequent fuel supply.

In the known solutions of the stoves, the way of solid fuel supply, especially coal supply, consists of fuel supplying directly into the storage container, from which fuel is dosed to a retort in the combustion chamber throughout e.g. warm feeder. Fuel supplying takes place in the open space and the containers are designed so that the fuel pouring always produces large amount of dust, which reduces the comfort of stove service and changes the nature of the boiler—the room becomes dirty zone. Dust comes out of the boiler room area messing up the other utility rooms. Dust is also generated during coal transport e.g. to the storage place at the building and into the stove. Stove cleaning as well as ash removal are producing additional amount of dust. For these reasons, coal heating is considered to be uncomfortable and dirty and requires frequent and less comfortable, for the user, service.

SUMMARY OF THE INVENTION

The solution according to the invention overcomes the above mentioned disadvantages resulting from coal transport, fuel storage as well as fuel charge into the stove bin and stove cleaning.

The essence of the solution according to the invention is the new method and charging system designed to replenish stove with fine granulated solid fuel, in which the entire fuel delivery process, beginning from the purchasing through transport to storage, takes place in sealed returnable containers. A container for fuel storage and stove supply with the fuel is hermetic, and the fuel charging from the container takes place by tight connection with charging chamber and charging container in the stove. After placing the container in a specially constructed charging chamber and removing the container cover, fuel is drawn from the container gravitationally, and then by the sealed feeding device—belt conveyor is being dosed into the stove chamber. The tight connections of all elements both during fuel delivery and dosing, prevent dust from getting out, and the container exchange is limited to the removal of the empty container and installing the full one. This eliminates frequent stove charging, which can generate large amount of dust.

BRIEF DESCRIPTION OF THE DRAWINGS

The subject of the invention is shown in the enclosed illustrative material, in which.

DETAILED DESCRIPTION OF THE INVENTION

Figure 1:
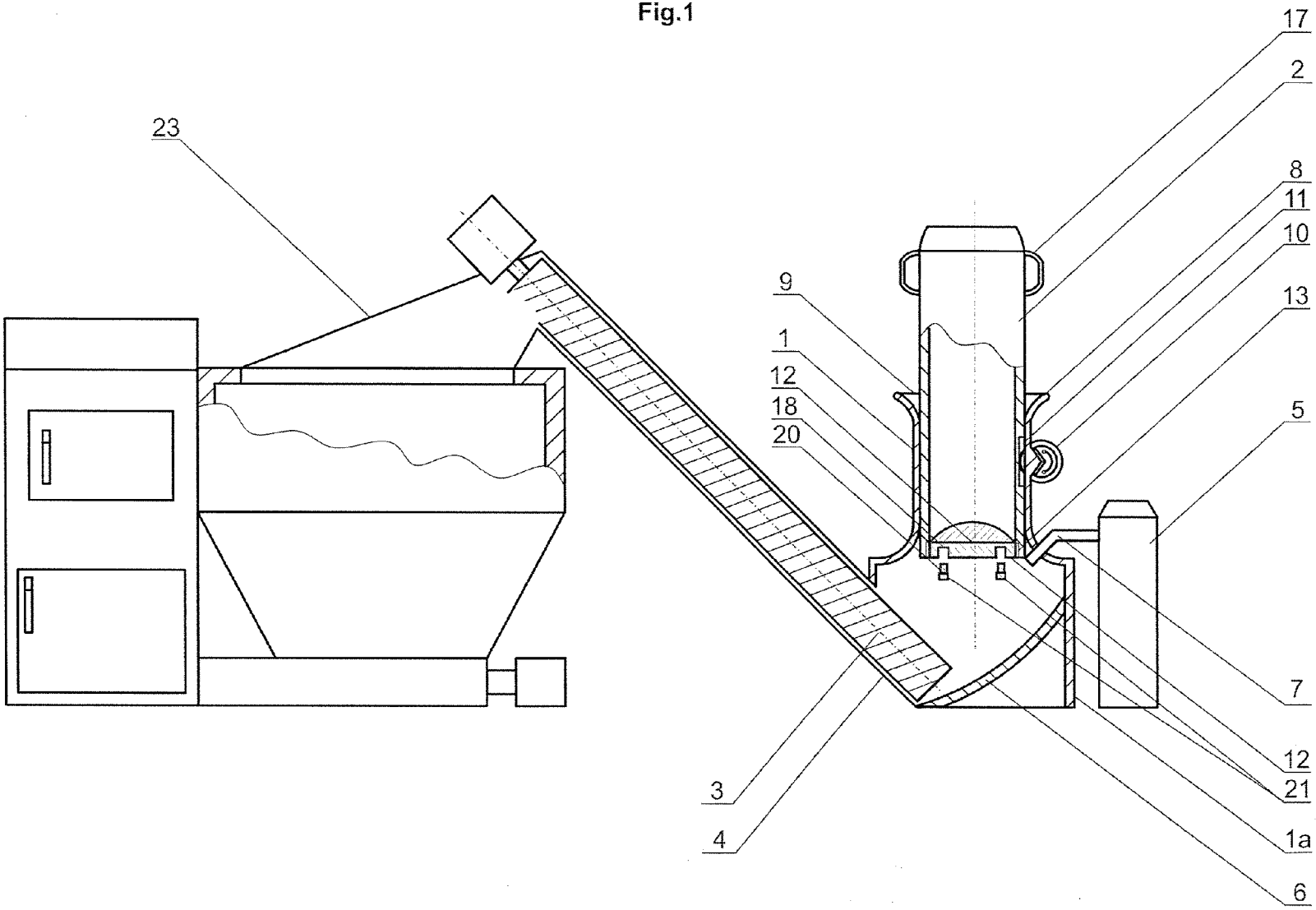
FIG. 1 shows a cross-section of the charging system.
Figure 2:
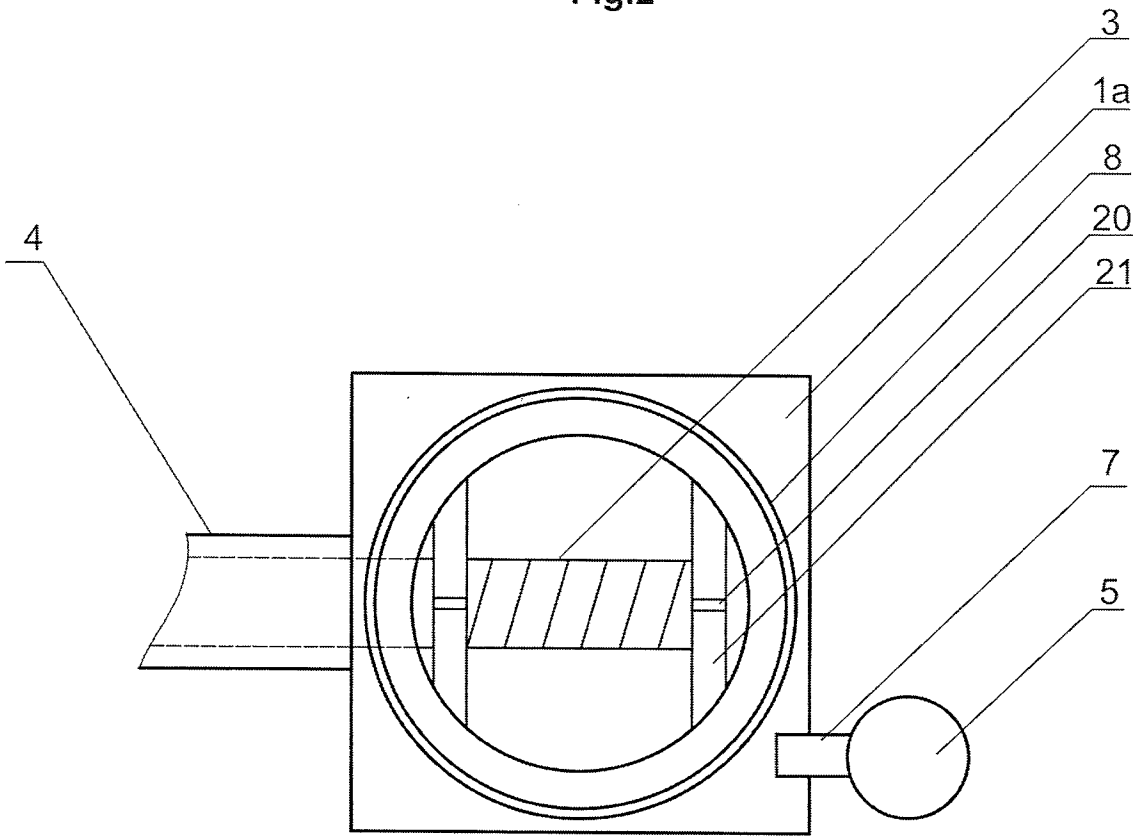
FIG. 2 shows a top view of the charging system.
Figure 3:
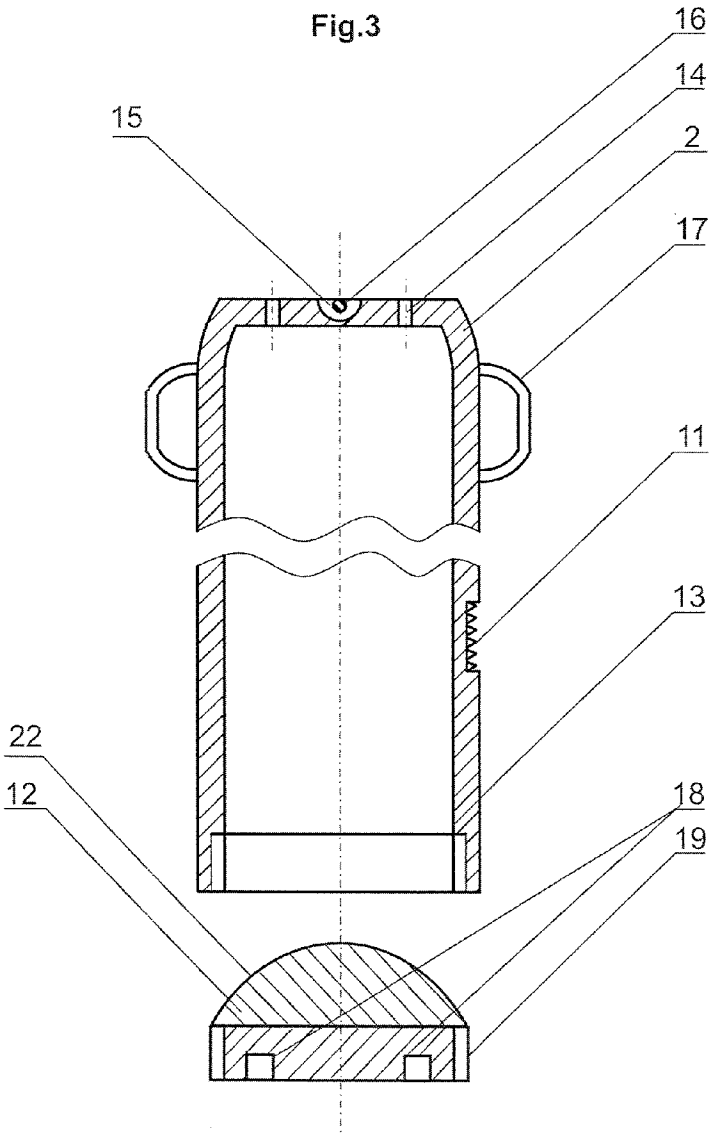
FIG. 3 shows a cross-section of the container body.
Figure 4:
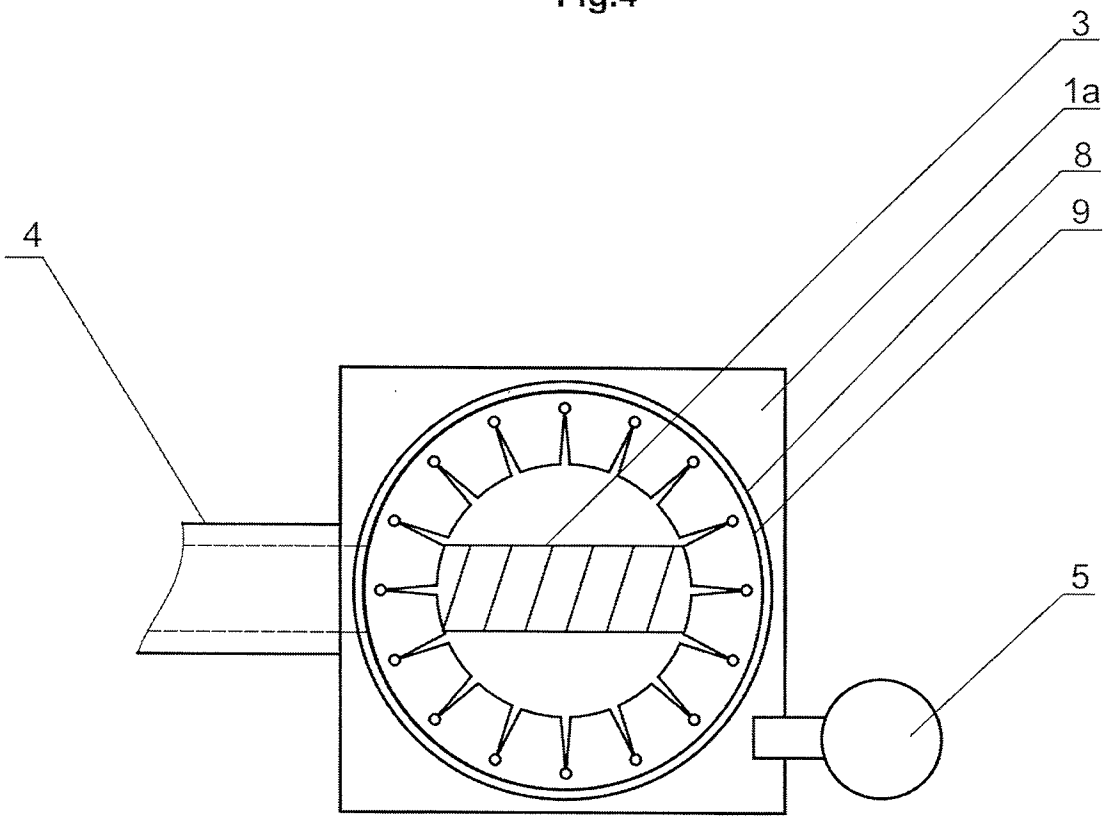
FIG. 4 shows a top view of the charging chamber with the membrane.

The charging system for dust-free fuel charging consists of loading chamber 1, a container 2 for fuel, and a belt conveyor 3, transporting fuel to the charging chamber of the stove 23, located in a closed chamber 4.

Rectangular lower part, charging 1*a*, of the bipartite loading chamber 1, is closed at the lower part by a arched profiled surface of the bottom 6, arranged at an angle in relation to the walls of the chamber 1*a*, wherein the surface 6 in the lower part is connected with the chamber 4 of the belt conveyor 3. In the lower part of the chamber there is an inlet of suction port 7 of the turbine 5, which is started when the container 2*r* is placed in the chamber 1*r*, sucking in air together with the dust generated in the chamber when fuel is being poured out.

In the upper part, charging chamber 1 has cylindrical shape, in which the top edge 8 has arched outline, forming funnel profile, which is closed at the inlet by a flexible membrane 9. The membrane seals the container junction with the chamber, preventing dust from getting out during fuel pouring. The ratchet mechanism 10, which stabilizes position and motion of the container 2 in the chamber, is arranged on the external surface of the chamber 1.

The container 2 consists of cylindrical body and the cover 12, preferably made of plastic material and separably fastened by a threaded connection 13,19. The toothed bar 11, which together with the ratchet mechanism 10, positions the container during fuel charging and fuel pouring process, is situated on the external surface of the container 2. In the bottom of the container there are symmetrically arranged pass-through holes 14, for draining water, contained in the fuel, and in the center of the bottom there is arched relief 15, wherein holder 16 is placed. The planar outline of the bottom allows to storage number of containers one above the other in vertical position. In the upper part of the container on the external surface, there are holders 17, symmetrically arranged on both sides, for moving and rotating the container during turning on and turning off the cover 12.

The cover 12 has the cylindrical shape, wherein the upper surface of the cover—bottom 22, has a spherical profile, and the external surface is threaded 13. Spherical outline of the cover bottom 22, from the inside of the container 2, allows coal to pour out gravitationally to feeding pocket after turning on and shifting up the container. Rectangular pockets 18 are located on the planar part of the external cover 12. The pockets, when container 2 is being placed in the chamber 1, are fixed in the hooks 20, preventing rotational movement of the cover and its unscrewing from the container body. The hooks 20 are located in the middle of the brackets 21, which are mounted horizontally to the walls of charging chamber 1*a*. The brackets 21 are both the base and support for the cover 12. After turning on, the cover is supported on the brackets and the hooks 20 prevent from rotational movement of the cover.

The system is operating as follows. During the feeding process, the container 2 is placed in the pocket of loading chamber 1. The container should be turned in such a way that hooks 20 in the loading pocket 1*a* hit the cut-outs 18 in the cover in order to stabilize and then turn on the cover 12. After the rotation needed to turn on the cover, user raises the container 2, separating it from the cover 12, which is being placed in the hooks 20 on the brackets 21. Driving out of he container is restricted by the ratchet mechanism 10, which locks up when the container body 2 is driven out on a fixed height between cover 12 and the container, which allows for gravitational fuel pouring out to the inside of the chamber 1*a*. At the same time the mechanism blocs up the vertical position of the body and its falling to the pocket. The fuel which is pouring out through the shaped surface of the bottom 6 successively is directed on the conveyor 3 and then transported in the chamber 4 to the charging chamber 23 of the stove. After complete emptying the container, user unlocks the ratchet in the mechanism 10, allowing for the vertical movement of the container 2. Then user inserts the container 2, moving it down vertically up to the stop, until the container is laced over the thread 13 of the cover 12. While the container is being returned, the cover is fastened to the container by means of threaded connection 13, 19, and the user removes empty container driving it out from the pocket by the hooks 16,17.

The invention claimed is:

1. A charging system for dust-free fuel feeding, comprising:

a loading chamber (1);

a container (2); and a belt conveyor (3) located in a chamber (4), wherein the loading chamber (1) is bipartite and a lower part of the loading chamber, charging (1*a*), is a rectangular body, closed in the lower part by an arched profiled surface of the bottom (6), located at an angle in respect to walls of chamber (1*a*), connected in the lower part with the chamber (4) of the belt conveyor (3), wherein brackets (21) are placed in an upper part of the chamber, fastened horizontally to the wall of the charging chamber (1*a*), and in the lower part of the chamber there is an inlet of suction port (7) of turbine (5), and the loading chamber (1) has a cylindrical shape, wherein a top edge (8) has an arched outline, forming a funnel profile, closed at the inlet by a flexible membrane (9) and a ratchet mechanism (10) is placed on an external surface of the chamber (1).

2. The charging system according to claim 1, wherein the container (2), which comprises of the cylindrical body and the cover (12, fastened by threaded connection (13), (19), wherein on the external surface of the container (2) there is the toothed bar (11), and on the bottom of the container pass-through holes (14) are arranged symmetrically, and in the middle of the bottom there is arched relief (15) wherein holder (16) is placed, in the upper part of the container on the external surface hooks (17) are symmetrically arranged on both sides.

3. The system according to the claim 1, distinguished by the cover (12), which has cylindrical shape and the upper surface of the cover (22) has spherical profile and the external surface is threaded (13), and on the lower surface of the planar cover (12) rectangular pockets (18) are located.

4. The method of dust-free fuel charging distinguished by the container 2, which is placed in the pocket of the charging chamber (1) in such a way that hooks (20) being placed in the charging pocket (1*a*) hit the cut-outs (18), and then cover (12) is being turned on by the rotation of the container and the cover is being placed in the hooks (20) on the brackets (21), wherein ratchet mechanism (10) locks up the container (2) body between the cover (12) and the container at the height allowing the fuel to pour out into the chamber (1*a*), then the fuel is directed throughout the shaped surface of the bottom (6) onto the conveyor (3) placed in the chamber (4) and next to the charging chamber (23) of the stove.

* * * * *